US011308886B2

(12) United States Patent
Cheng

(10) Patent No.: US 11,308,886 B2
(45) Date of Patent: Apr. 19, 2022

(54) PIXEL DRIVING CIRCUIT THAT CAN PERFORM A REVERSE BIAS RESET TO AN OLED, AND PIXEL DRIVING METHOD

(71) Applicant: WUHAN CHINA STAR OPTOELECTRONICS SEMICONDUCTOR DISPLAY TECHNOLOGY CO., LTD., Wuhan (CN)

(72) Inventor: Jiangkun Cheng, Wuhan (CN)

( * ) Notice: Subject to any disclaimer, the term of this patent is extended or adjusted under 35 U.S.C. 154(b) by 144 days.

(21) Appl. No.: 16/753,863

(22) PCT Filed: Jan. 16, 2020

(86) PCT No.: PCT/CN2020/072350
§ 371 (c)(1),
(2) Date: Apr. 6, 2020

(87) PCT Pub. No.: WO2021/134839
PCT Pub. Date: Jul. 8, 2021

(65) Prior Publication Data

US 2021/0407423 A1 Dec. 30, 2021

(30) Foreign Application Priority Data

Dec. 31, 2019 (CN) ..... 201911406540.9

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01)

(58) Field of Classification Search
None
See application file for complete search history.

(56) References Cited

U.S. PATENT DOCUMENTS

| | | | | |
|---|---|---|---|---|
| 2003/0112205 | A1 | 6/2003 | Yamada | |
| 2004/0090186 | A1 | 5/2004 | Yoshida et al. | |
| 2006/0244695 | A1 | 11/2006 | Komiya | |
| 2010/0201722 | A1 | 8/2010 | Masumoto et al. | |
| 2011/0193885 | A1 | 8/2011 | Lee et al. | |
| 2014/0333600 | A1 * | 11/2014 | Lee | G09G 3/325 345/212 |
| 2015/0221252 | A1 | 8/2015 | Qing et al. | |

(Continued)

FOREIGN PATENT DOCUMENTS

| | | | |
|---|---|---|---|
| CN | 1427382 | A | 7/2003 |
| CN | 1499471 | A | 5/2004 |

(Continued)

*Primary Examiner* — Kirk W Hermann

(57) ABSTRACT

A pixel driving circuit includes: a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode (OLED). Gates of the seventh thin film transistor and the eighth thin film transistor respectively input a first scanning signal and a second scanning signal, and when the first scanning signal is at a low level, a reverse bias reset can be performed on the OLED.

11 Claims, 4 Drawing Sheets

(56) References Cited

U.S. PATENT DOCUMENTS

| | | | | |
|---|---|---|---|---|
| 2016/0125808 | A1* | 5/2016 | Hsu | G09G 3/3233 345/212 |
| 2017/0193901 | A1 | 7/2017 | Wang et al. | |
| 2018/0204516 | A1 | 7/2018 | Hwang et al. | |
| 2019/0221165 | A1* | 7/2019 | Park | G09G 3/3291 |
| 2020/0074928 | A1* | 3/2020 | Li | G09G 3/3233 |

FOREIGN PATENT DOCUMENTS

| | | | |
|---|---|---|---|
| CN | 1874627 | A | 12/2006 |
| CN | 101933072 | A | 12/2010 |
| CN | 103440843 | A | 12/2013 |
| CN | 105427806 | A | 3/2016 |
| CN | 105895020 | A | 8/2016 |
| CN | 109272932 | A | 1/2019 |
| CN | 109584803 | A | 4/2019 |
| CN | 110060635 | A | 7/2019 |
| JP | 2005017485 | A | 1/2005 |
| KR | 100902221 | B1 * | 6/2009 |
| KR | 100902221 | B1 | 6/2009 |

* cited by examiner

PIXEL DRIVING CIRCUIT THAT CAN PERFORM A REVERSE BIAS RESET TO AN OLED, AND PIXEL DRIVING METHOD

FIELD OF INVENTION

The present disclosure relates to the field of display technologies, and more particularly to a pixel driving circuit and a pixel driving method.

BACKGROUND OF INVENTION

Organic light emitting diodes (OLEDs), as a current-emitting light emitting device, are increasingly being used in the field of high-performance displays due to their characteristics of self-emission, fast response, wide viewing angles, and fabrication on flexible substrates, etc. OLED display devices can be divided into passive matrix driving OLEDs (PMOLEDs) and active matrix driving OLEDs (AMOLEDs) according to different driving methods. Because AMOLED displays have advantages of low manufacturing cost, high response speed, power saving, direct drive (DC) for portable devices, and wide operating temperature range, AMOLEDs have received increasing attention from display technology developers.

Organic light emitting diode technologies such as AMOLEDs, as an emerging technology for flat display, have a series of advantages such as thin, flexible, bendable, high contrast, high response rates, high color saturation, etc. compared to other traditional display technologies. It is more and more widely used in smart phones, smart televisions (TVs), smart cars, and other terminals. With popularization of AMOLEDs, consumers need higher and higher life expectancy. Light emitting materials of AMOLEDs are organic. As usage time increases, brightness will gradually decline, eventually affecting a user experience.

FIG. 1 illustrates the most typical pixel driving circuit. When scan (n) is low, Vi can reset an anode of an OLED. Since Vi is a gate reset voltage of T1, its voltage value cannot be too low to avoid time required for data writing. Typical driving voltage settings are Vi: −3.5V, and ELVSS: −4V. Therefore, Vi cannot perform a reverse bias reset on the OLED. In addition, scan (n) is low for too short a time. Overall, a circuit as illustrated in FIG. 1 cannot produce a reverse bias effect on the OLED.

SUMMARY OF INVENTION

Embodiments of the present application provide a pixel driving circuit and a pixel driving method, which can improve a light emitting lifetime of an active matrix driving OLED (AMOLED) by increasing a reverse bias time of an OLED and adjusting a reverse bias voltage.

To solve the above issues, technical solutions provided by the present invention are as follows:

An embodiment of the present invention provides a pixel driving circuit, comprising: a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode; wherein the seventh thin film transistor and the eighth thin film transistor are connected to each other, a source of the seventh thin film transistor is connected to a sixth node, a drain of the seventh thin film transistor is connected to a seventh node, a gate of the seventh thin film transistor is connected to a first scanning signal; a drain of the eighth thin film transistor is connected to the sixth node, a source of the eighth thin film transistor is connected to the seventh node, and a gate of the eighth thin film transistor is connected to a second scanning signal; wherein the sixth node is also connected to a second reset voltage, the seventh node is connected to an eighth node, the eighth node is connected to a first pole of the organic light emitting diode; wherein the second reset voltage is a peripheral voltage; and wherein when the first scanning signal is at a low level, the seventh thin film transistor is turned on, and the organic light emitting diode is subjected to reverse bias reset by the second reset voltage.

In an embodiment of the present invention, the first thin film transistor is connected to a second node and a ninth node, is turned on in response to a signal of a first node, and connects the second node and the ninth node; the second thin film transistor is connected to the second node, and is turned on in response to a signal of a fourth node, and transmits a data signal to the second node; the fourth node is connected to the first scanning signal; the third thin film transistor is connected to the first node and the ninth node, is turned on in response to a signal of the fourth node, and connects the first node and the ninth node; the fourth thin film transistor is connected to a third node, is turned on in response to the second scanning signal, and transmits a first reset voltage signal to the third node; the fifth thin film transistor is connected to the second node and a fifth node, is turned on in response to a first control signal, and connects the second node and the fifth node; the fifth node is connected to a first power signal; the sixth thin film transistor is connected to the ninth node and the eighth node, is turned on in response to the first control signal, and connects the eighth node and the ninth node; a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

In an embodiment of the present invention, a gate of the first thin film transistor is connected to the first node, a source of the first thin film transistor is connected to the second node, and a drain of the first thin film transistor is connected to the ninth node; a gate of the second thin film transistor is connected to the fourth node, a source of the second thin film transistor is connected to the data signal, and a drain of the second thin film transistor is connected to the second node; and a gate of the third thin film transistor is connected to the fourth node, a source of the third thin film transistor is connected to the first node, and a drain of the third thin film transistor is connected to the ninth node.

In an embodiment of the present invention, a gate of the fourth thin film transistor is connected to the second scanning signal, a source of the fourth thin film transistor is connected to the first reset voltage signal, and a drain of the fourth thin film transistor is connected to the third node; a gate of the fifth thin film transistor is connected to a gate of the sixth thin film transistor, a source of the fifth thin film transistor is connected to the fifth node, and a drain of the fifth thin film transistor is connected to the second node; and the gate of the sixth thin film transistor is connected to the gate of the fifth thin film transistor, a source of the sixth thin film transistor is connected to the ninth node, and a drain of the sixth thin film transistor is connected to the eighth node; wherein the gate of the sixth thin film transistor is further connected to the first control signal.

In an embodiment of the present invention, the pixel driving circuit is connected to Nth and N+1th scanning signal lines; wherein the Nth scanning signal line is configured to output the first scanning signal, the N+1th scanning signal line is configured to output the second scanning signal line; N is a positive integer.

In an embodiment of the present invention, a plurality of the pixel driving circuits are arranged in N rows, and wherein the second scanning signal in the pixel driving circuit in an nth row is multiplexed with the first scanning signal in the pixel driving circuit in an n−1th row; n∈N, N and n are both positive integers.

In an embodiment of the present invention, in the pixel driving circuit, the first thin film transistor, the second thin film transistor, the third thin film transistor, the fourth thin film transistor, the fifth thin film transistor, the sixth thin film transistor, the seventh thin film transistor, and the eighth thin film transistor are P-type thin film transistors or N-type thin film transistors.

An embodiment of the present invention further provides a pixel driving circuit, comprising: a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode; wherein the seventh thin film transistor and the eighth thin film transistor are connected to each other, a source of the seventh thin film transistor is connected to a sixth node, a drain of the seventh thin film transistor is connected to a seventh node, a gate of the seventh thin film transistor is connected to a second scanning signal; a drain of the eighth thin film transistor is connected to the sixth node, a source of the eighth thin film transistor is connected to the seventh node, and a gate of the eighth thin film transistor is connected to a first scanning signal; wherein the sixth node is also connected to a second reset voltage, the seventh node is connected to an eighth node, the eighth node is connected to a first pole of the organic light emitting diode; wherein the second reset voltage is a peripheral voltage; and wherein when the first scanning signal is at a low level, the seventh thin film transistor is turned on, and the organic light emitting diode is subjected to reverse bias reset by the second reset voltage.

In an embodiment of the present invention, the first thin film transistor is connected to a second node and a ninth node, is turned on in response to a signal of a first node, and connects the second node and the ninth node; the second thin film transistor is connected to the second node, and is turned on in response to a signal of a fourth node, and transmits a data signal to the second node; the fourth node is connected to the first scanning signal; the third thin film transistor is connected to the first node and the ninth node, is turned on in response to a signal of the fourth node, and connects the first node and the ninth node; the fourth thin film transistor is connected to a third node, is turned on in response to the second scanning signal, and transmits a first reset voltage signal to the third node; the fifth thin film transistor is connected to the second node and a fifth node, is turned on in response to a first control signal, and connects the second node and the fifth node; the fifth node is connected to a first power signal; the sixth thin film transistor is connected to the ninth node and the eighth node, is turned on in response to the first control signal, and connects the eighth node and the ninth node; a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

In an embodiment of the present invention, a gate of the first thin film transistor is connected to the first node, a source of the first thin film transistor is connected to the second node, and a drain of the first thin film transistor is connected to the ninth node; a gate of the second thin film transistor is connected to the fourth node, a source of the second thin film transistor is connected to the data signal, and a drain of the second thin film transistor is connected to the second node; and a gate of the third thin film transistor is connected to the fourth node, a source of the third thin film transistor is connected to the first node, and a drain of the third thin film transistor is connected to the ninth node.

In an embodiment of the present invention, a gate of the fourth thin film transistor is connected to the second scanning signal, a source of the fourth thin film transistor is connected to the first reset voltage signal, and a drain of the fourth thin film transistor is connected to the third node; a gate of the fifth thin film transistor is connected to a gate of the sixth thin film transistor, a source of the fifth thin film transistor is connected to the fifth node, and a drain of the fifth thin film transistor is connected to the second node; and the gate of the sixth thin film transistor is connected to the gate of the fifth thin film transistor, a source of the sixth thin film transistor is connected to the ninth node, and a drain of the sixth thin film transistor is connected to the eighth node; wherein the gate of the sixth thin film transistor is further connected to the first control signal.

In an embodiment of the present invention, the pixel driving circuit is connected to Nth and N+1th scanning signal lines; wherein the Nth scanning signal line is configured to output the first scanning signal, the N+1th scanning signal line is configured to output the second scanning signal line; N is a positive integer.

In an embodiment of the present invention, a plurality of the pixel driving circuits are arranged in N rows, and wherein the second scanning signal in the pixel driving circuit in an nth row is multiplexed with the first scanning signal in the pixel driving circuit in an n−1th row; n∈N, N and n are both positive integers.

In an embodiment of the present invention, in the pixel driving circuit, the first thin film transistor, the second thin film transistor, the third thin film transistor, the fourth thin film transistor, the fifth thin film transistor, the sixth thin film transistor, the seventh thin film transistor, and the eighth thin film transistor are P-type thin film transistors or N-type thin film transistors.

An embodiment of the present invention further provides a pixel driving method of driving a pixel driving circuit, wherein the pixel driving circuit comprises: a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode; wherein the seventh thin film transistor and the eighth thin film transistor are connected to each other, a source of the seventh thin film transistor is connected to a sixth node, a drain of the seventh thin film transistor is connected to a seventh node, a gate of the seventh thin film transistor is connected to a first scanning signal; a drain of the eighth thin film transistor is connected to the sixth node, a source of the eighth thin film transistor is connected to the seventh node, and a gate of the eighth thin film transistor is connected to a second scanning signal; wherein the sixth node is also connected to a second reset voltage, the seventh node is connected to an eighth node, the eighth node is connected to a first pole of the organic light emitting diode; wherein the second reset voltage is a peripheral voltage; wherein the pixel driving method comprises: when the first scanning signal is at a low level, the seventh thin film transistor is turned on, and the organic light emitting diode is subjected to reverse bias reset by the second reset voltage; or when the second scanning signal is at a low level, the seventh thin film transistor is turned on, and the organic light emitting diode is subjected to reverse bias reset by the second reset voltage.

In an embodiment of the present invention, in the pixel driving circuit, the first thin film transistor is connected to a second node and a ninth node, is turned on in response to a signal of a first node, and connects the second node and the ninth node; the second thin film transistor is connected to the second node, and is turned on in response to a signal of a fourth node, and transmits a data signal to the second node; the fourth node is connected to the first scanning signal; the third thin film transistor is connected to the first node and the ninth node, is turned on in response to a signal of the fourth node, and connects the first node and the ninth node; the fourth thin film transistor is connected to a third node, is turned on in response to the second scanning signal, and transmits a first reset voltage signal to the third node; the fifth thin film transistor is connected to the second node and a fifth node, is turned on in response to a first control signal, and connects the second node and the fifth node; the fifth node is connected to a first power signal; the sixth thin film transistor is connected to the ninth node and the eighth node, is turned on in response to the first control signal, and connects the eighth node and the ninth node; a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

In an embodiment of the present invention, the pixel driving circuit comprises: the first thin film transistor, the second thin film transistor, the third thin film transistor, the fourth thin film transistor, the fifth thin film transistor, the sixth thin film transistor, the seventh thin film transistor, the eighth thin film transistor, the first capacitor, and the organic light emitting diode; wherein the seventh thin film transistor and the eighth thin film transistor are connected to each other, the source of the seventh thin film transistor is connected to the sixth node, the drain of the seventh thin film transistor is connected to the seventh node, the gate of the seventh thin film transistor is connected to the second scanning signal; the drain of the eighth thin film transistor is connected to the sixth node, the source of the eighth thin film transistor is connected to the seventh node, and the gate of the eighth thin film transistor is connected to the first scanning signal; wherein the sixth node is also connected to the second reset voltage, the seventh node is connected to an eighth node, the eighth node is connected to the first pole of the organic light emitting diode; wherein the second reset voltage is the peripheral voltage; wherein when the second scanning signal is at the low level, the seventh thin film transistor is turned on, and the organic light emitting diode is subjected to reverse bias reset by the second reset voltage.

In an embodiment of the present invention, in the pixel driving circuit, the first thin film transistor is connected to a second node and a ninth node, is turned on in response to a signal of a first node, and connects the second node and the ninth node; the second thin film transistor is connected to the second node, and is turned on in response to a signal of a fourth node, and transmits a data signal to the second node; the fourth node is connected to the first scanning signal; the third thin film transistor is connected to the first node and the ninth node, is turned on in response to a signal of the fourth node, and connects the first node and the ninth node; the fourth thin film transistor is connected to a third node, is turned on in response to the second scanning signal, and transmits a first reset voltage signal to the third node; the fifth thin film transistor is connected to the second node and a fifth node, is turned on in response to a first control signal, and connects the second node and the fifth node; the fifth node is connected to a first power signal; the sixth thin film transistor is connected to the ninth node and the eighth node, is turned on in response to the first control signal, and connects the eighth node and the ninth node; a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

Beneficial Effect:

Embodiments of the present invention disclose a pixel driving circuit and a pixel driving method. Applying a reverse bias to the OLED through the pixel driving circuit improves issues of OLED brightness attenuation and increases a life of the OLED.

DESCRIPTION OF DRAWINGS

In order to explain the technical solution in the embodiment or the prior art more clearly, the accompanying drawings used in the description of the embodiment or the prior art will be briefly introduced below. Obviously, the drawings in the following description are only some embodiments of the present invention. For those of ordinary skill in the art, other drawings can be obtained according to these drawings without paying creative efforts.

DETAILED DESCRIPTION OF PREFERRED EMBODIMENTS

Figure 1:
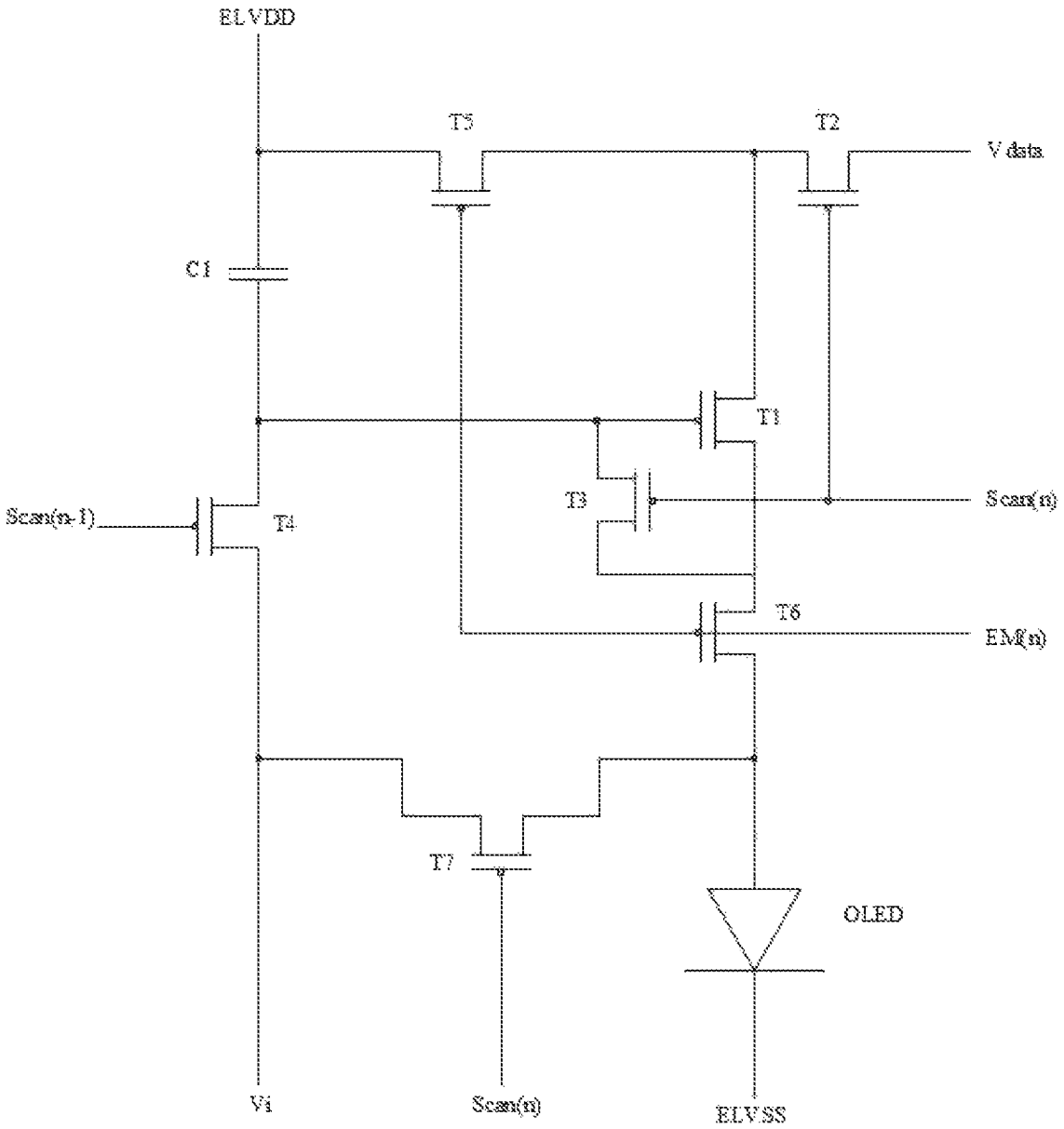
FIG. 1 Prior Art
FIG. 1 is a schematic diagram of a pixel driving circuit in the prior art.

The technical solutions in the embodiments of the present application will be clearly and completely described below with reference to the drawings in the embodiments of the present application. Obviously, the described embodiments are only a part of the embodiments of the present application, but not all the embodiments. Based on the embodiments in the present application, all other embodiments obtained by those skilled in the art without creative efforts fall into the protection scope of the present application.

In the description of the present application, it should be understood that terms such as "center", "longitudinal", "transverse", "length", "width", "thickness", "upper", "lower", "front", "back", "left", "right", "vertical", "horizontal", "top", "bottom", "inside", "outside", "clockwise", "counterclockwise", etc. indicating a direction or a positional relationship are based on an orientation or positional relationship shown in the drawings. This is only for the convenience of describing the present application and simplifying the description and does not indicate or imply that the device or element referred to must have a particular orientation, be constructed and operate in a particular orientation. Therefore, it cannot be understood as a limitation on the present application. In addition, the terms "first" and "second" are used for descriptive purposes only and cannot be understood as indicating or implying relative importance or implicitly indicating the number of technical features indicated. Therefore, the features defined as "first" and "second" may explicitly or implicitly include one or more of the features. In the description of the present application, the meaning of "a plurality" is two or more, unless specifically defined otherwise.

In the description of the present application, it should be noted that the terms "installation", "link", and "connection" should be interpreted in a broad sense unless otherwise specified and limited. For example, it may be a fixed connection, a detachable connection, or an integral connection. It can be a mechanical connection, an electrical connection or can communicate with each other. It can be directly connected or indirectly connected through an intermediate medium. It can be the internal connection of two elements or the interaction between two elements. For those of ordinary skill in the art, the specific meanings of the above terms in the present application can be understood according to specific situations.

In the present application, unless explicitly stated and limited otherwise, a first feature "above" or "below" a second feature may include direct contact between the first and second features, or it may include that the first and second features are not in direct contact but are contacted through another feature between them. Moreover, the first feature is "above", "over", and "on" the second feature, including that the first feature is directly above and obliquely above the second feature, or merely indicates that the first feature is higher in level than the second feature. The first feature is "below", "under", and "underneath" the second feature, including that the first feature is directly below and obliquely below the second feature, or merely indicates that the first feature is less in level than the second feature.

The following disclosure provides many different implementations or examples for implementing different structures of the present application. To simplify the disclosure of the present application, the components and settings of specific examples are described below. Of course, they are merely examples and are not intended to limit the present application. In addition, the present application may repeat reference numbers and/or reference letters in different examples. This repetition is for the sake of simplicity and clarity and does not in itself indicate the relationship between the various embodiments and/or settings discussed. In addition, the present application provides examples of various specific processes and materials. However, those of ordinary skill in the art may recognize the present application of other processes and/or the use of other materials.

Embodiments of the present application provide a pixel driving circuit and a pixel driving method, which can improve a light emitting lifetime of an active matrix driving organic light emitting diode (AMOLED) by increasing a reverse bias time of an OLED and adjusting a reverse bias voltage.

Figure 2:
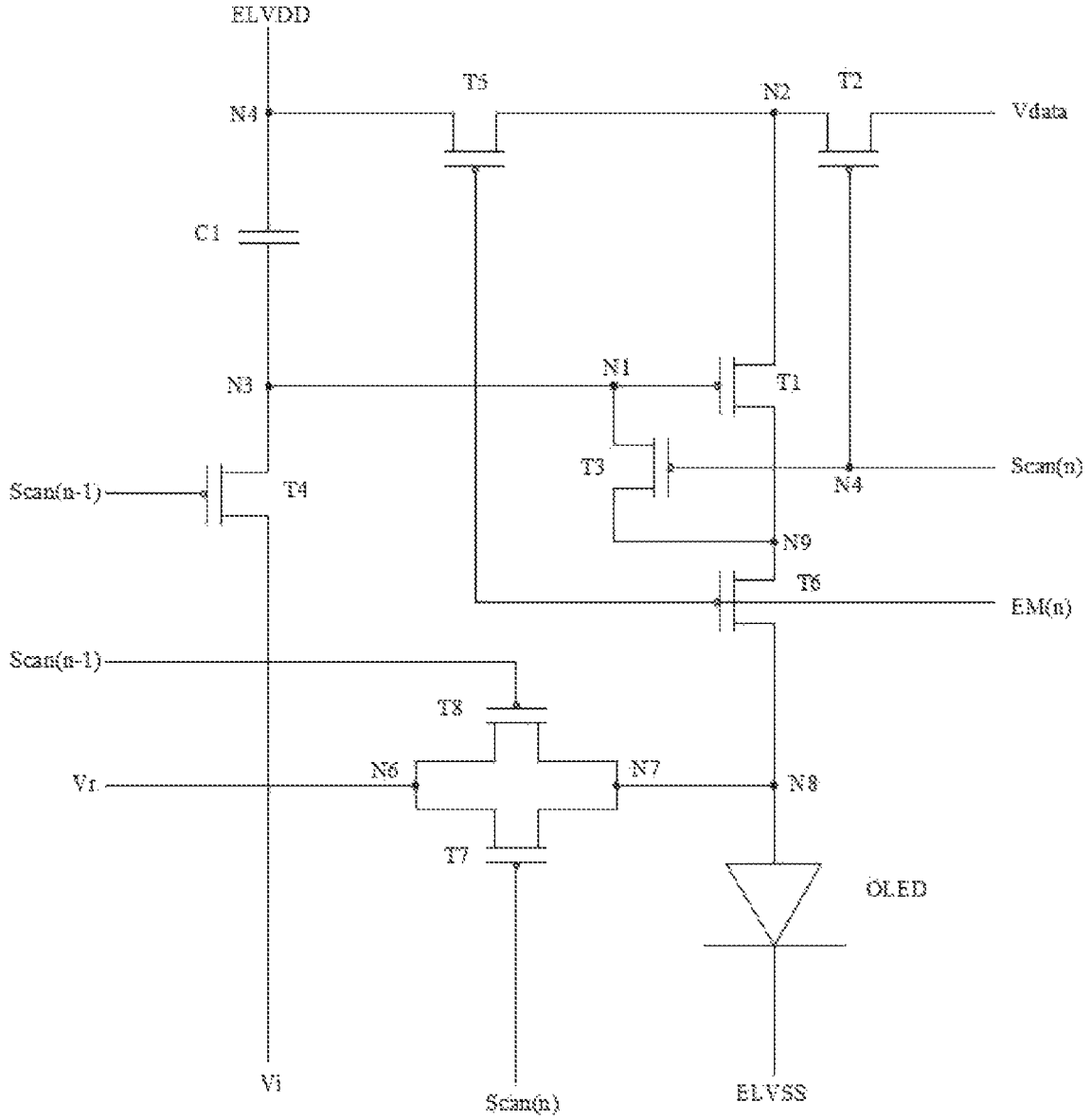
FIG. 2 is a schematic diagram of a pixel driving circuit according to an exemplary embodiment.

A pixel driving circuit is provided in an exemplary embodiment for driving an electroluminescent element. Referring to FIG. 2, the pixel driving circuit comprises: a first thin film transistor T1, a second thin film transistor T2, a third thin film transistor T3, a fourth thin film transistor T4, a fifth thin film transistor T5, a sixth thin film transistor T6, a seventh thin film transistor T7, an eighth thin film transistor T8, a first capacitor C1, and an organic light emitting diode OLED.

In an embodiment of the present invention, the first thin film transistor T1 is connected to a second node N2 and a ninth node N9, is turned on in response to a signal of a first node N1, and connects the second node N2 and the ninth node N9; the second thin film transistor T2 is connected to the second node N2, and is turned on in response to a signal of a fourth node N4, and transmits a data signal Vdata to the second node N2; the fourth node N4 is connected to the first scanning signal Scan(n); the third thin film transistor T3 is connected to the first node N1 and the ninth node N9, is turned on in response to a signal of the fourth node N4, and connects the first node N1 and the ninth node N9; the fourth thin film transistor T4 is connected to a third node N3, is turned on in response to the second scanning signal Scan (n−1), and transmits a first reset voltage signal Vi to the third node N3; the fifth thin film transistor T5 is connected to the second node N2 and a fifth node N5, is turned on in response to a first control signal EM(n), and connects the second node N2 and the fifth node N5; the fifth node N5 is connected to a first power signal ELVDD; the sixth thin film transistor T6 is connected to the ninth node N9 and the eighth node N8, is turned on in response to the first control signal EM(n), and connects the eighth node N8 and the ninth node N9; the seventh thin film transistor T7 and the eighth thin film transistor T8 are connected to each other, that is, a source of the seventh thin film transistor T7 is connected to a sixth node N6, a drain of the seventh thin film transistor T7 is connected to a seventh node N7, a gate of the seventh thin film transistor T7 is connected to a first scanning signal Scan(n); a drain of the eighth thin film transistor T8 is connected to the sixth node N6, a source of the eighth thin film transistor T8 is connected to the seventh node N7, and a gate of the eighth thin film transistor T8 is connected to a second scanning signal Scan(n−1), the sixth node N6 is also connected to a second reset voltage Vr, the seventh node N7 is connected to an eighth node N8, the eighth node N8 is connected to a first pole of the organic light emitting diode OLED; wherein the second reset voltage Vr is a peripheral voltage and is not affected by other thin film transistors such as the first thin film transistor T1.

When the first scanning signal Scan(n) is at a low level, the seventh thin film transistor T7 is turned on, and the organic light emitting diode OLED is subjected to reverse bias reset by the second reset voltage Vr.

In an embodiment of the present invention, in the pixel driving circuit, the first thin film transistor T1, the second thin film transistor T2, the third thin film transistor T3, the fourth thin film transistor T4, the fifth thin film transistor T5, the sixth thin film transistor T6, the seventh thin film transistor T7, and the eighth thin film transistor T8 are P-type thin film transistors or N-type thin film transistors. Each of the thin film transistors has a gate, a source, and a drain. Specifically, a connection relationship between the thin film transistors is as follows:

A gate of the first thin film transistor T1 is connected to the first node N1, a source of the first thin film transistor T1 is connected to the second node N2, and a drain of the first thin film transistor T1 is connected to the ninth node N9; a gate of the second thin film transistor T2 is connected to the fourth node N4, a source of the second thin film transistor T2 is connected to the data signal Vdata, and a drain of the second thin film transistor T2 is connected to the second node N2; and a gate of the third thin film transistor T3 is connected to the fourth node N4, a source of the third thin film transistor T3 is connected to the first node N1, and a drain of the third thin film transistor T3 is connected to the ninth node N9. A gate of the fourth thin film transistor T4 is connected to the second scanning signal Scan(n−1), a source of the fourth thin film transistor T4 is connected to the first reset voltage signal Vi, and a drain of the fourth thin film transistor T4 is connected to the third node N3; a gate of the fifth thin film transistor T5 is connected to a gate of the sixth thin film transistor T6, a source of the fifth thin film transistor T5 is connected to the fifth node N5, and a drain of the fifth thin film transistor T5 is connected to the second node N2; and the gate of the sixth thin film transistor T6 is connected to the gate of the fifth thin film transistor T5, a source of the sixth thin film transistor T6 is connected to the ninth node N9, and a drain of the sixth thin film transistor T6 is connected to the eighth node N8; wherein the gate of the sixth thin film transistor T6 is further connected to the first control signal EM(n). A source of the seventh thin film transistor T7 is connected to a sixth node N6, a drain of the seventh thin film transistor T7 is connected to a seventh node N7, a gate of the seventh thin film transistor T7 is connected to a first scanning signal Scan(n); a drain of the eighth thin film transistor T8 is connected to the sixth node N6, a source of the eighth thin film transistor T8 is connected to the seventh node N7, and a gate of the eighth thin film transistor T8 is connected to a second scanning signal Scan(n−1), the sixth node N6 is also connected to a second reset voltage Vr, the seventh node N7 is connected to an eighth node N8, the eighth node N8 is connected to a first pole of the organic light emitting diode OLED; wherein the second reset voltage Vr is a peripheral voltage and is not affected by other thin film transistors such as the first thin film transistor T1.

The type of the first capacitor C1 in this implementation may be selected according to a specific circuit, which is not particularly limited in this exemplary embodiment. The organic light emitting diode OLED has a first pole and a second pole. For example, the first pole of the organic light emitting diode OLED may be an anode, and the second pole of the organic light emitting diode OLED may be a cathode. As another example, a first pole of the organic light emitting diode OLED may be a cathode, and a second pole of the organic light emitting diode OLED may be an anode.

In the plurality of pixel driving circuits arranged in an array, in order to multiplex the first scanning signal and the second scanning signal in each pixel driving circuit, the circuit structure of the plurality of pixel driving circuits arranged in an array is simplified and progressive scanning is implemented. The pixel driving circuit in this embodiment is connected to the scanning signal lines of Nth and N+1th rows. The N-th scanning signal line is used to output the first scanning signal. The N+1th scanning signal line is used to output the second scanning signal line. N is a positive integer. Specifically, the third thin film transistor T3 and the seventh thin film transistor T7 in the pixel driving circuit are connected to the Nth row of scanning signal lines. The fourth thin film transistor T4 and the eighth thin film transistor T8 in the pixel driving circuit are connected to the Nth scanning signal line.

Further, in an embodiment of the present invention, a plurality of the pixel driving circuits are arranged in N rows, and wherein the second scanning signal in the pixel driving circuit in an nth row is multiplexed with the first scanning signal in the pixel driving circuit in an n−1th row; n∈N, N and n are both positive integers.

Figure 3:
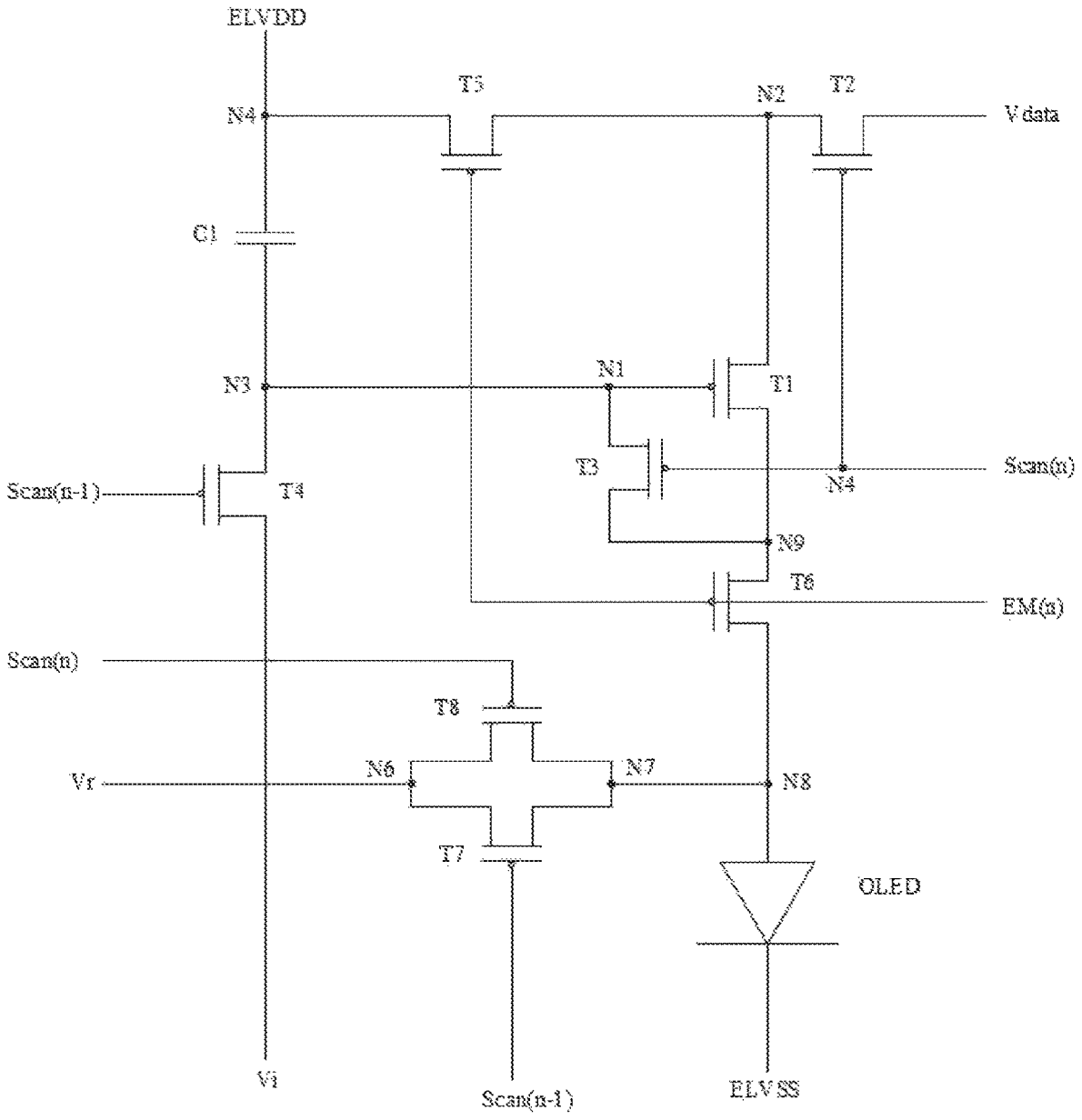
FIG. 3 is a schematic diagram of another pixel driving circuit according to an exemplary embodiment.

A pixel driving circuit is further provided in an exemplary embodiment for driving an electroluminescent element. Referring to FIG. 3, the pixel driving circuit comprises: a first thin film transistor T1, a second thin film transistor T2, a third thin film transistor T3, a fourth thin film transistor T4, a fifth thin film transistor T5, a sixth thin film transistor T6, a seventh thin film transistor T7, an eighth thin film transistor T8, a first capacitor C1, and an organic light emitting diode OLED.

In an embodiment of the present invention, the first thin film transistor T1 is connected to a second node N2 and a ninth node N9, is turned on in response to a signal of a first node N1, and connects the second node N2 and the ninth node N9; the second thin film transistor T2 is connected to the second node N2, and is turned on in response to a signal of a fourth node N4, and transmits a data signal Vdata to the second node N2; the fourth node N4 is connected to the first scanning signal Scan(n); the third thin film transistor T3 is connected to the first node N1 and the ninth node N9, is turned on in response to a signal of the fourth node N4, and connects the first node N1 and the ninth node N9; the fourth thin film transistor T4 is connected to a third node N3, is turned on in response to the second scanning signal Scan (n−1), and transmits a first reset voltage signal Vi to the third node N3; the fifth thin film transistor T5 is connected to the second node N2 and a fifth node N5, is turned on in response to a first control signal EM(n), and connects the second node N2 and the fifth node N5; the fifth node N5 is connected to a first power signal ELVDD; the sixth thin film transistor T6 is connected to the ninth node N9 and the eighth node N8, is turned on in response to the first control signal EM(n), and connects the eighth node N8 and the ninth node N9; the seventh thin film transistor T7 and the eighth thin film transistor T8 are connected to each other, that is, a source of the seventh thin film transistor T7 is connected to a sixth node N6, a drain of the seventh thin film transistor T7 is connected to a seventh node N7, a gate of the seventh thin film transistor T7 is connected to a first scanning signal Scan(n); a drain of the eighth thin film transistor T8 is connected to the sixth node N6, a source of the eighth thin film transistor T8 is connected to the seventh node N7, and a gate of the eighth thin film transistor T8 is connected to a second scanning signal Scan(n−1), the sixth node N6 is also connected to a second reset voltage Vr, the seventh node N7 is connected to an eighth node N8, the eighth node N8 is connected to a first pole of the organic light emitting diode OLED; wherein the second reset voltage Vr is a peripheral voltage and is not affected by other thin film transistors such as the first thin film transistor T1.

When the second scanning signal Scan(n−1) is at a low level, the seventh thin film transistor T7 is turned on, and the organic light emitting diode OLED is subjected to reverse bias reset by the second reset voltage Vr.

In an embodiment of the present invention, in the pixel driving circuit, the first thin film transistor T1, the second thin film transistor T2, the third thin film transistor T3, the fourth thin film transistor T4, the fifth thin film transistor T5, the sixth thin film transistor T6, the seventh thin film transistor T7, and the eighth thin film transistor T8 are P-type thin film transistors or N-type thin film transistors. Each of the thin film transistors has a gate, a source, and a drain. Specifically, a connection relationship between the thin film transistors is as follows:

A gate of the first thin film transistor T1 is connected to the first node N1, a source of the first thin film transistor T1 is connected to the second node N2, and a drain of the first thin film transistor T1 is connected to the ninth node N9; a gate of the second thin film transistor T2 is connected to the fourth node N4, a source of the second thin film transistor T2 is connected to the data signal Vdata, and a drain of the second thin film transistor T2 is connected to the second node N2; and a gate of the third thin film transistor T3 is connected to the fourth node N4, a source of the third thin film transistor T3 is connected to the first node N1, and a drain of the third thin film transistor T3 is connected to the ninth node N9. A gate of the fourth thin film transistor T4 is connected to the second scanning signal Scan(n−1), a source of the fourth thin film transistor T4 is connected to the first reset voltage signal Vi, and a drain of the fourth thin film transistor T4 is connected to the third node N3; a gate of the fifth thin film transistor T5 is connected to a gate of the sixth thin film transistor T6, a source of the fifth thin film transistor T5 is connected to the fifth node N5, and a drain of the fifth thin film transistor T5 is connected to the second node N2; and the gate of the sixth thin film transistor T6 is connected to the gate of the fifth thin film transistor T5, a source of the sixth thin film transistor T6 is connected to the ninth node N9, and a drain of the sixth thin film transistor T6 is connected to the eighth node N8; wherein the gate of the sixth thin film transistor T6 is further connected to the first control signal EM(n). A source of the seventh thin film transistor T7 is connected to a sixth node N6, a drain of the seventh thin film transistor T7 is connected to a seventh node N7, a gate of the seventh thin film transistor T7 is connected to a first scanning signal Scan(n); a drain of the eighth thin film transistor T8 is connected to the sixth node N6, a source of the eighth thin film transistor T8 is connected to the seventh node N7, and a gate of the eighth thin film transistor T8 is connected to a second scanning signal Scan(n−1), the sixth node N6 is also connected to a second reset voltage Vr, the seventh node N7 is connected to an eighth node N8, the eighth node N8 is connected to a first pole of the organic light emitting diode OLED; wherein the second reset voltage Vr is a peripheral voltage and is not affected by other thin film transistors such as the first thin film transistor T1.

The type of the first capacitor C1 in this implementation may be selected according to a specific circuit, which is not particularly limited in this exemplary embodiment. The organic light emitting diode OLED has a first pole and a second pole. For example, the first pole of the organic light emitting diode OLED may be an anode, and the second pole of the organic light emitting diode OLED may be a cathode. As another example, a first pole of the organic light emitting diode OLED may be a cathode, and a second pole of the organic light emitting diode OLED may be an anode.

In the plurality of pixel driving circuits arranged in an array, in order to multiplex the first scanning signal and the second scanning signal in each pixel driving circuit, the circuit structure of the plurality of pixel driving circuits arranged in an array is simplified and progressive scanning is implemented. The pixel driving circuit in this embodiment is connected to the scanning signal lines of Nth and N+1th rows. The N-th scanning signal line is used to output the first scanning signal. The N+1th scanning signal line is used to output the second scanning signal line. N is a positive integer. Specifically, the third thin film transistor T3 and the seventh thin film transistor T7 in the pixel driving circuit are connected to the Nth row of scanning signal lines. The fourth thin film transistor T4 and the eighth thin film transistor T8 in the pixel driving circuit are connected to the Nth scanning signal line.

Further, in an embodiment of the present invention, a plurality of the pixel driving circuits are arranged in N rows, and wherein the second scanning signal in the pixel driving circuit in an nth row is multiplexed with the first scanning signal in the pixel driving circuit in an n−1th row; n∈N, N and n are both positive integers.

Figure 4:
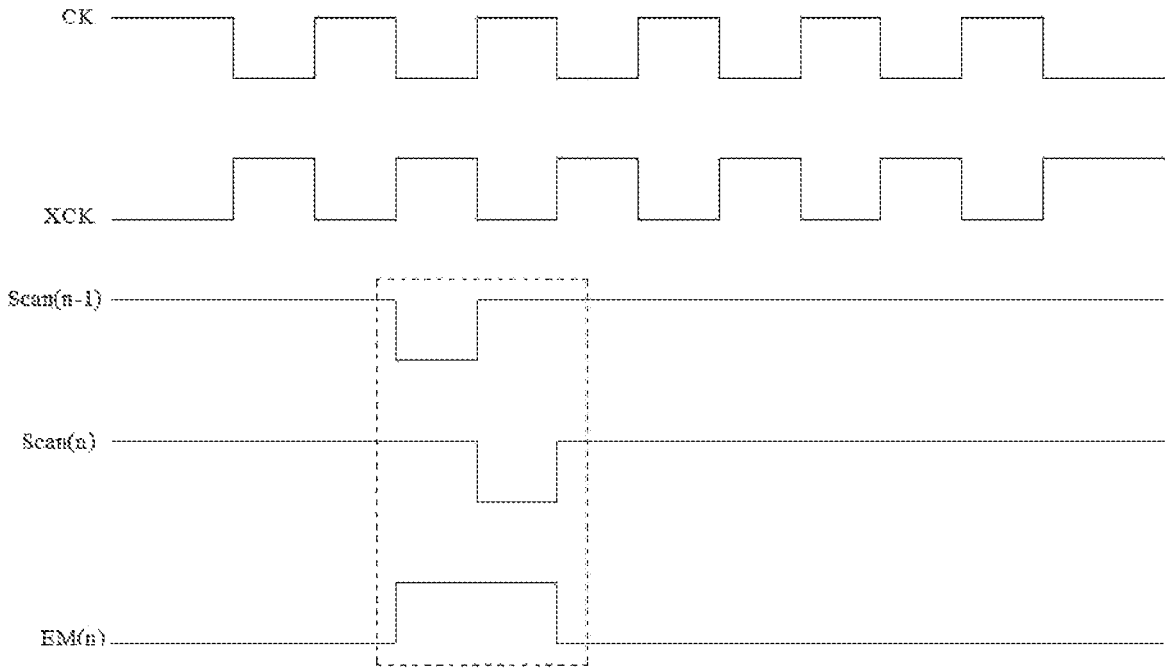
FIG. 4 is a timing diagram of a pixel driving circuit according to an exemplary embodiment.

In an exemplary embodiment of the present disclosure, a pixel driving method is also provided of driving a pixel driving circuit as shown in FIG. 2 or FIG. 3. Hereinafter, the working process of the pixel driving circuit in FIG. 2 or FIG. 3 will be described in detail with reference to the working timing diagram of the pixel driving circuit shown in FIG. 4. The thin film transistors described in the exemplary embodiments of the present disclosure all take a P type thin film transistor as an example. Turn-on signals of the thin film transistors are all low level signals. Turn-off signals of the thin film transistors are all high level signals. The driving timing diagram shows CK, XCK, a first scan signal Scan (n), a second scan signal Scan (n−1), and a first control signal EM (n).

Because the second reset voltage Vr is a peripheral voltage, it is not affected by other thin film transistors such as the first thin film transistor. A gate of the seventh thin film transistor T7 is input with the first scanning signal Scan (n). A gate of the eighth thin film transistor T8 is input with the second scanning signal Scan (n−1). When the first scanning signal Scan (n) is at a low level, it can be seen from the timing of the dotted frame area in the timing chart in FIG. 4 that the corresponding second scanning signal Scan (n−1) is at a high level. When the first scanning signal Scan (n) is at a high level, it can be seen from the timing of the dotted frame area in the timing chart in FIG. 4 that the corresponding second scanning signal Scan (n−1) is at a low level. The first control signal EM (n) is always maintained at a high level. Therefore, by setting a proper voltage of the second reset voltage Vr, the organic light emitting diode OLED can be reset by a reverse bias. Compared with the pixel driving circuit in FIG. 1 in the prior art, the reset time of the organic light emitting diode OLED in this exemplary embodiment is doubled. The second reset voltage Vr is input by a peripheral circuit. This can be adjusted according to the optimal reverse bias voltage and is not affected by the thin film transistor described in the embodiment.

Alternatively, the gate of the seventh thin film transistor T7 is input with the second scanning signal Scan (n−1). A gate of the eighth thin film transistor T8 inputs the first scanning signal Scan (n). When the second scanning signal Scan (n−1) is at a low level, it can be seen from the timing of the dotted frame area in the timing chart in FIG. 4 that the corresponding first scanning signal Scan (n) is at a high level. When the second scanning signal Scan (n−1) is at a high level, it can be seen from the timing of the dotted frame area in the timing chart in FIG. 4 that the corresponding first scanning signal Scan (n) is at a low level. The first control signal EM (n) is always maintained at a high level. Therefore, by setting a proper voltage of the second reset voltage Vr, the organic light emitting diode OLED can be reset by a reverse bias. Compared with the pixel driving circuit in FIG. 1 in the prior art, the reset time of the organic light emitting diode OLED in this exemplary embodiment is doubled. The second reset voltage Vr is input by a peripheral circuit and can be adjusted according to an optimal reverse bias voltage without being affected by the thin film transistor in the embodiment.

It should be noted that in the above specific embodiments, all the switching elements are P type thin film transistors. However, those skilled in the art can easily obtain a pixel driving circuit in which all the thin film transistors are N type thin film transistors according to the pixel driving circuit provided by the present disclosure. In an exemplary embodiment of the present disclosure, all the thin film transistors may be N type thin film transistors. Because the thin film transistors are all N-type thin film transistors, turn-on signals of the thin film transistors are all high level. Of course, the pixel driving circuit provided in the present disclosure may also be changed to a complementary metal oxide semiconductor (CMOS) circuit, etc., and is not limited to the pixel driving circuit provided in this embodiment, which is not repeated here.

The pixel driving circuit and the pixel driving method provided in the embodiments of the present application have been described in detail above. Specific examples are used herein to explain the principles and implementation of this application. The descriptions of the above embodiments are only used to help understand the technical solutions of the present application and its core ideas. Those of ordinary skill in the art should understand that they can still modify the technical solutions described in the foregoing embodiments or replace some of the technical features equivalently. These modifications or replacements do not make the essence of the corresponding technical solutions outside the scope of the technical solutions of the embodiments of the present application.

What is claimed is:

1. A pixel driving circuit, comprising:

a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode;

wherein the seventh thin film transistor and the eighth thin film transistor are connected to each other, a source of the seventh thin film transistor is connected to a sixth node, a drain of the seventh thin film transistor is connected to a seventh node, a gate of the seventh thin film transistor is connected to a first scanning signal; a drain of the eighth thin film transistor is connected to the sixth node, a source of the eighth thin film transistor is connected to the seventh node, and a gate of the eighth thin film transistor is connected to a second scanning signal;

wherein the sixth node is also connected to a second reset voltage, the seventh node is connected to an eighth node, the eighth node is connected to a first pole of the organic light emitting diode; wherein the second reset voltage is a peripheral voltage; and wherein when the first scanning signal is at a low level, the seventh thin film transistor is turned on, and the organic light emitting diode is subjected to reverse bias reset by the second reset voltage;

wherein the first thin film transistor is connected to a second node and a ninth node, is turned on in response to a signal of a first node, and connects the second node and the ninth node;

the second thin film transistor is connected to the second node, and is turned on in response to a signal of a fourth node, and transmits a data signal to the second node; the fourth node is connected to the first scanning signal;

the third thin film transistor is connected to the first node and the ninth node, is turned on in response to a signal of the fourth node, and connects the first node and the ninth node;

the fourth thin film transistor is connected to a third node, is turned on in response to the second scanning signal, and transmits a first reset voltage signal to the third node;

the fifth thin film transistor is connected to the second node and a fifth node, is turned on in response to a first control signal, and connects the second node and the fifth node; the fifth node is connected to a first power signal;

the sixth thin film transistor is connected to the ninth node and the eighth node, is turned on in response to the first control signal, and connects the eighth node and the ninth node;

a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

2. The pixel driving circuit according to claim 1, wherein a gate of the first thin film transistor is connected to the first node, a source of the first thin film transistor is connected to the second node, and a drain of the first thin film transistor is connected to the ninth node;

a gate of the second thin film transistor is connected to the fourth node, a source of the second thin film transistor is connected to the data signal, and a drain of the second thin film transistor is connected to the second node; and a gate of the third thin film transistor is connected to the fourth node, a source of the third thin film transistor is connected to the first node, and a drain of the third thin film transistor is connected to the ninth node.

3. The pixel driving circuit according to claim 2, wherein a gate of the fourth thin film transistor is connected to the second scanning signal, a source of the fourth thin film transistor is connected to the first reset voltage signal, and a drain of the fourth thin film transistor is connected to the third node;

a gate of the fifth thin film transistor is connected to a gate of the sixth thin film transistor, a source of the fifth thin film transistor is connected to the fifth node, and a drain of the fifth thin film transistor is connected to the second node; and the gate of the sixth thin film transistor is connected to the gate of the fifth thin film transistor, a source of the sixth thin film transistor is connected to the ninth node, and a drain of the sixth thin film transistor is connected to the eighth node; wherein the gate of the sixth thin film transistor is further connected to the first control signal.

4. The pixel driving circuit according to claim 1, wherein the pixel driving circuit is connected to Nth and N+1th scanning signal lines; wherein the Nth scanning signal line is configured to output the first scanning signal, the N+1th scanning signal line is configured to output the second scanning signal; N is a positive integer.

5. A pixel driving circuit, comprising:

a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode;

wherein the seventh thin film transistor and the eighth thin film transistor are connected to each other, a source of the seventh thin film transistor is connected to a sixth node, a drain of the seventh thin film transistor is connected to a seventh node, a gate of the seventh thin film transistor is connected to a second scanning signal; a drain of the eighth thin film transistor is connected to the sixth node, a source of the eighth thin film transistor is connected to the seventh node, and a gate of the eighth thin film transistor is connected to a first scanning signal;

wherein the sixth node is also connected to a second reset voltage, the seventh node is connected to an eighth node, the eighth node is connected to a first pole of the organic light emitting diode; wherein the second reset voltage is a peripheral voltage; and wherein when the first scanning signal is at a low level, the seventh thin film transistor is turned on, and the organic light emitting diode is subjected to reverse bias reset by the second reset voltage;

wherein the first thin film transistor is connected to a second node and a ninth node, is turned on in response to a signal of a first node, and connects the second node and the ninth node;

the second thin film transistor is connected to the second node, and is turned on in response to a signal of a fourth node, and transmits a data signal to the second node; the fourth node is connected to the first scanning signal;

the third thin film transistor is connected to the first node and the ninth node, is turned on in response to a signal of the fourth node, and connects the first node and the ninth node;

the fourth thin film transistor is connected to a third node, is turned on in response to the second scanning signal, and transmits a first reset voltage signal to the third node;

the fifth thin film transistor is connected to the second node and a fifth node, is turned on in response to a first control signal, and connects the second node and the fifth node; the fifth node is connected to a first power signal;

the sixth thin film transistor is connected to the ninth node and the eighth node, is turned on in response to the first control signal, and connects the eighth node and the ninth node;

a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

6. The pixel driving circuit according to claim 5, wherein a gate of the first thin film transistor is connected to the first node, a source of the first thin film transistor is connected to the second node, and a drain of the first thin film transistor is connected to the ninth node;

a gate of the second thin film transistor is connected to the fourth node, a source of the second thin film transistor is connected to the data signal, and a drain of the second thin film transistor is connected to the second node; and a gate of the third thin film transistor is connected to the fourth node, a source of the third thin film transistor is connected to the first node, and a drain of the third thin film transistor is connected to the ninth node.

7. The pixel driving circuit according to claim 6, wherein a gate of the fourth thin film transistor is connected to the second scanning signal, a source of the fourth thin film transistor is connected to the first reset voltage signal, and a drain of the fourth thin film transistor is connected to the third node;

a gate of the fifth thin film transistor is connected to a gate of the sixth thin film transistor, a source of the fifth thin film transistor is connected to the fifth node, and a drain of the fifth thin film transistor is connected to the second node; and the gate of the sixth thin film transistor is connected to the gate of the fifth thin film transistor, a source of the sixth thin film transistor is connected to the ninth node, and a drain of the sixth thin film transistor is connected to the eighth node; wherein the gate of the sixth thin film transistor is further connected to the first control signal.

8. The pixel driving circuit according to claim 5, wherein the pixel driving circuit is connected to Nth and N+1th scanning signal lines; wherein the Nth scanning signal line is configured to output the first scanning signal, the N+1th scanning signal line is configured to output the second scanning signal; N is a positive integer.

9. A pixel driving method of driving a pixel driving circuit, wherein the pixel driving circuit comprises:

a first thin film transistor, a second thin film transistor, a third thin film transistor, a fourth thin film transistor, a fifth thin film transistor, a sixth thin film transistor, a seventh thin film transistor, an eighth thin film transistor, a first capacitor, and an organic light emitting diode;

wherein the seventh thin film transistor and the eighth thin film transistor are connected to each other, a source of the seventh thin film transistor is connected to a sixth node, a drain of the seventh thin film transistor is connected to a seventh node, a gate of the seventh thin film transistor is connected to a first scanning signal; a drain of the eighth thin film transistor is connected to the sixth node, a source of the eighth thin film transistor is connected to the seventh node, and a gate of the eighth thin film transistor is connected to a second scanning signal;

wherein the sixth node is also connected to a second reset voltage, the seventh node is connected to an eighth node, the eighth node is connected to a first pole of the organic light emitting diode; wherein the second reset voltage is a peripheral voltage;

wherein the pixel driving method comprises:

when the first scanning signal is at a low level, the seventh thin film transistor is turned on, and the organic light emitting diode is subjected to reverse bias reset by the second reset voltage; or when the second scanning signal is at a low level, the seventh thin film transistor is turned on, and the organic light emitting diode is subjected to reverse bias reset by the second reset voltage;

wherein in the pixel driving circuit, the first thin film transistor is connected to a second node and a ninth node, is turned on in response to a signal of a first node, and connects the second node and the ninth node;

the second thin film transistor is connected to the second node, and is turned on in response to a signal of a fourth node, and transmits a data signal to the second node; the fourth node is connected to the first scanning signal;

the third thin film transistor is connected to the first node and the ninth node, is turned on in response to a signal of the fourth node, and connects the first node and the ninth node;

the fourth thin film transistor is connected to a third node, is turned on in response to the second scanning signal, and transmits a first reset voltage signal to the third node;

the fifth thin film transistor is connected to the second node and a fifth node, is turned on in response to a first control signal, and connects the second node and the fifth node; the fifth node is connected to a first power signal;

the sixth thin film transistor is connected to the ninth node and the eighth node, is turned on in response to the first control signal, and connects the eighth node and the ninth node;

a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

10. The pixel driving method according to claim 9, wherein the pixel driving circuit comprises:

the first thin film transistor, the second thin film transistor, the third thin film transistor, the fourth thin film transistor, the fifth thin film transistor, the sixth thin film transistor, the seventh thin film transistor, the eighth thin film transistor, the first capacitor, and the organic light emitting diode;

wherein the seventh thin film transistor and the eighth thin film transistor are connected to each other, the source of the seventh thin film transistor is connected to the sixth node, the drain of the seventh thin film transistor is connected to the seventh node, the gate of the seventh thin film transistor is connected to the second scanning signal; the drain of the eighth thin film transistor is connected to the sixth node, the source of the eighth thin film transistor is connected to the seventh node, and the gate of the eighth thin film transistor is connected to the first scanning signal;

wherein the sixth node is also connected to the second reset voltage, the seventh node is connected to an eighth node, the eighth node is connected to the first pole of the organic light emitting diode; wherein the second reset voltage is the peripheral voltage;

wherein when the second scanning signal is at the low level, the seventh thin film transistor is turned on, and the organic light emitting diode is subjected to reverse bias reset by the second reset voltage.

11. The pixel driving method according to claim 10, wherein in the pixel driving circuit, the first thin film transistor is connected to a second node and a ninth node, is turned on in response to a signal of a first node, and connects the second node and the ninth node;

the second thin film transistor is connected to the second node, and is turned on in response to a signal of a fourth node, and transmits a data signal to the second node; the fourth node is connected to the first scanning signal;

the third thin film transistor is connected to the first node and the ninth node, is turned on in response to a signal of the fourth node, and connects the first node and the ninth node;

the fourth thin film transistor is connected to a third node, is turned on in response to the second scanning signal, and transmits a first reset voltage signal to the third node;

the fifth thin film transistor is connected to the second node and a fifth node, is turned on in response to a first control signal, and connects the second node and the fifth node; the fifth node is connected to a first power signal;

the sixth thin film transistor is connected to the ninth node and the eighth node, is turned on in response to the first control signal, and connects the eighth node and the ninth node;

a first end of the first capacitor is connected to the third node, and a second end of the first capacitor is connected to the fifth node; and the first pole of the organic light emitting diode is connected to the eighth node, and a second pole of the organic light emitting diode is connected to a second power signal.

* * * * *